US006393613B1

(12) United States Patent
Sheu

(10) Patent No.: US 6,393,613 B1
(45) Date of Patent: May 28, 2002

(54) RAINCOAT-INTEGRATED BACKPACK ASSEMBLY

(75) Inventor: Johnny Sheu, Taipei (TW)

(73) Assignee: Comax Sporting Goods Co., Ltd., Taipei (TW)

( * ) Notice: Subject to any disclaimer, the term of this patent is extended or adjusted under 35 U.S.C. 154(b) by 13 days.

(21) Appl. No.: 09/884,252

(22) Filed: Jun. 19, 2001

(51) Int. Cl.[7] ..... A41D 1/00
(52) U.S. Cl. ..... 2/94; 224/153
(58) Field of Search ..... 2/94, 69, 93, 108, 2/85–86, 88–89, 247, 249–252, 69.5; 224/153, 575, 577; 383/4

(56) References Cited

U.S. PATENT DOCUMENTS 4,689,831 A * 9/1987 Greenberger et al. ..... 2/93
5,165,111 A * 11/1992 Lieberman ..... 2/94
5,407,112 A * 4/1995 Christodoulou et al. .... 224/153
5,526,969 A * 6/1996 Greenberger ..... 224/153
5,573,166 A * 11/1996 Leja ..... 224/630
5,692,237 A * 12/1997 Bennett ..... 2/93
6,134,712 A * 10/2000 Spector ..... 2/94

* cited by examiner

*Primary Examiner*—Gloria M. Hale
*Assistant Examiner*—Tejash Patel
(74) *Attorney, Agent, or Firm*—Akin, Gump, Strauss, Hauer & Feld, L.L.P.

(57) ABSTRACT

A raincoat-integrated backpack assembly includes a raincoat, and a bag body that confines a main receiving space therein and that has a raincoat retaining pouch which confines a raincoat receiving space therein for receiving the raincoat, a pouch opening for permitting access to the raincoat receiving space, and a closure device for closing the pouch opening. A connecting member is disposed in the raincoat receiving space, and includes male and female interlocking members which are respectively secured to the raincoat and the bag body and which are engageable to each other so as to permit attachment of the raincoat to the bag body.

3 Claims, 3 Drawing Sheets

RAINCOAT-INTEGRATED BACKPACK ASSEMBLY

BACKGROUND OF THE INVENTION

1. Field of the Invention

This invention relates to a raincoat-integrated backpack assembly that includes a bag body and a raincoat attached to the bag body.

2. Description of the Related Art

Conventional bags are normally provided with pouches for receiving small articles, such as pens, loose change, etc.. However, conventional bags are not designed with a pouch for receiving a raincoat. As a consequence, there is a tendency that people are unwilling to carry a raincoat along with the conventional bag during outdoor activities, which may lead to an awkward situation when an unexpected rainfall occurs.

SUMMARY OF THE INVENTION

Therefore, it is an object of the present invention to provide a raincoat-integrated backpack assembly that is capable of overcoming the aforementioned drawbacks.

According to this invention, there is provided a raincoat-integrated backpack assembly that comprises: a raincoat; a bag body that confines a main receiving space therein and that has a raincoat retaining pouch which confines a raincoat receiving space therein for receiving the raincoat, a pouch opening for permitting access to the raincoat receiving space, and a closure device for closing the pouch opening; and a connecting member disposed in the raincoat receiving space and including male and female interlocking members which are respectively secured to the raincoat and the bag body and which are engageable to each other so as to permit attachment of the raincoat to the bag body.

BRIEF DESCRIPTION OF THE DRAWINGS

In drawings which illustrate embodiments of the invention.

DETAILED DESCRIPTION OF THE PREFERRED EMBODIMENTS

Figure 1:
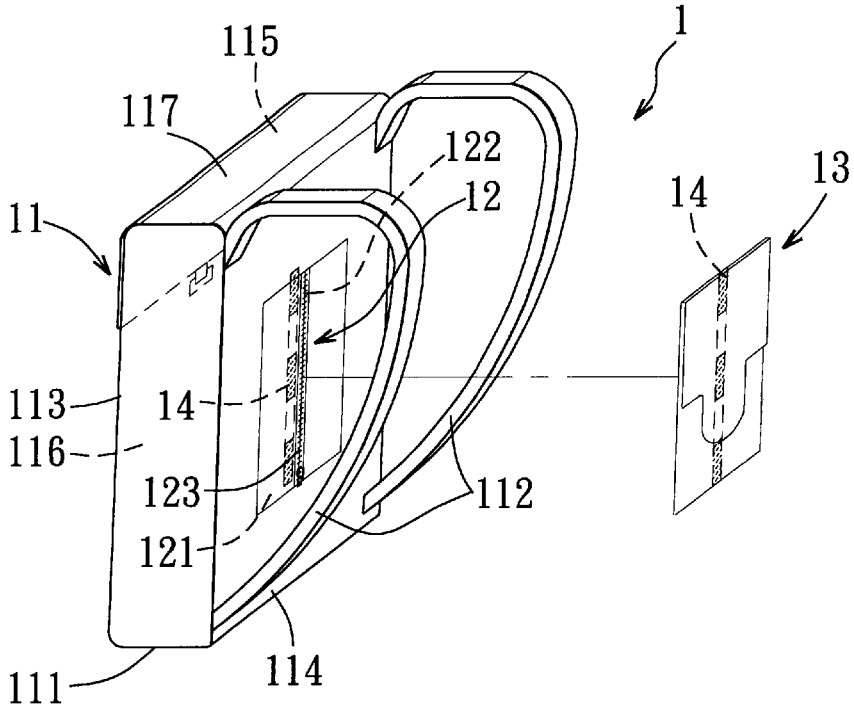
FIG. 1 is an exploded perspective view of a preferred embodiment of a raincoat-integrated backpack assembly of this invention, illustrating a raincoat that is integrated with a bag body in a folded condition.
Figure 2:
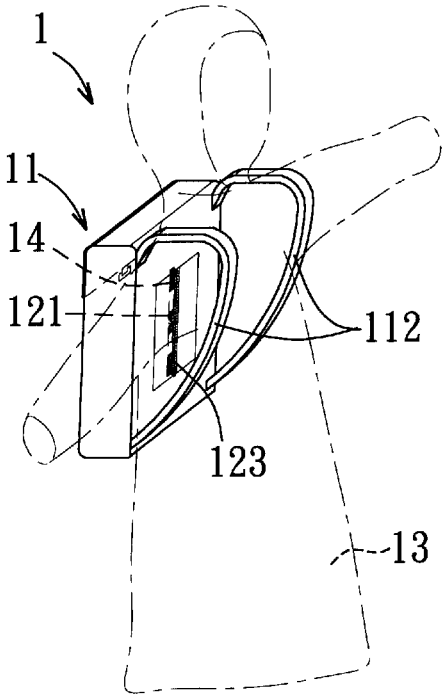
FIG. 2 is a perspective view of the backpack assembly of FIG. 1, illustrating the raincoat in an unfolded condition.
Figure 3:
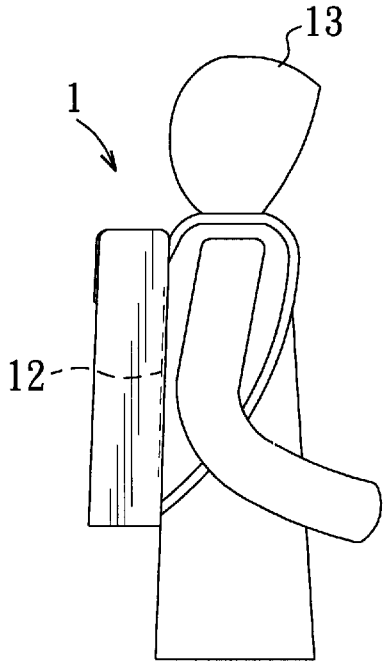
FIG. 3 illustrates how the raincoat is used together with the bag body of FIG. 1.

FIGS. 1 to 3 illustrate a preferred embodiment of a raincoat-integrated backpack assembly 1 of this invention. The backpack assembly 1 includes: a raincoat 13; a bag body 11 that confines a main receiving space 116 therein and that has front and rear walls 113, 114, a bottom wall 111, a top opening 115, a top cover 117 for covering the top opening 115, a pair of spaced apart shoulder straps 112 having ends connected to the rear wall 114, a raincoat retaining pouch 12 that defines a raincoat retaining space 121 therein for receiving the raincoat 13, a pouch opening 122 for permitting access to the raincoat receiving space 121, and a closure device 123, such as a zipper, for closing the pouch opening 122; and a connecting member 14 that is disposed in the raincoat retaining space 121 and that includes male and female interlocking members, such as Velcro™ hook-and-loop fasteners, which are respectively secured to the raincoat 13 and the bag body 11 and which are engageable to each other so as to permit attachment of the raincoat 13 to the bag body 11.

Figure 4:
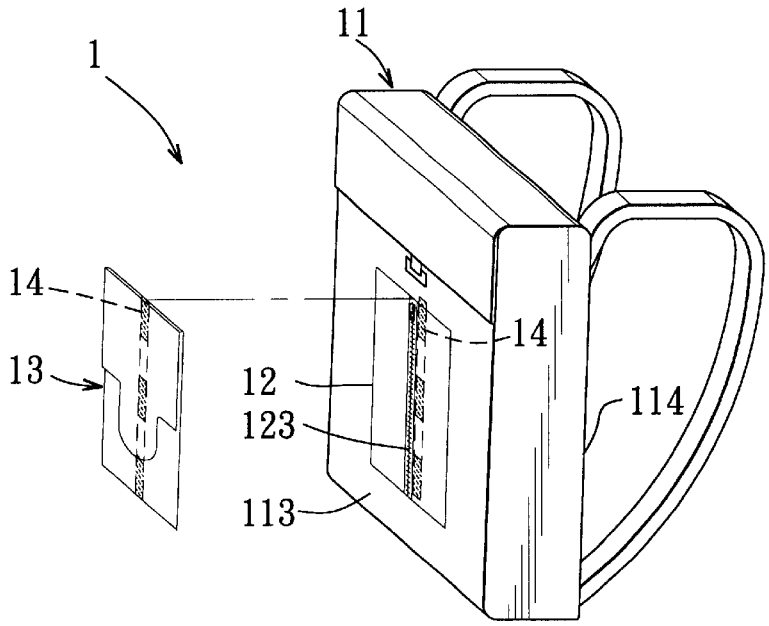
FIG. 4 is an exploded perspective view of another referred embodiment of the backpack assembly of this invention.
Figure 5:
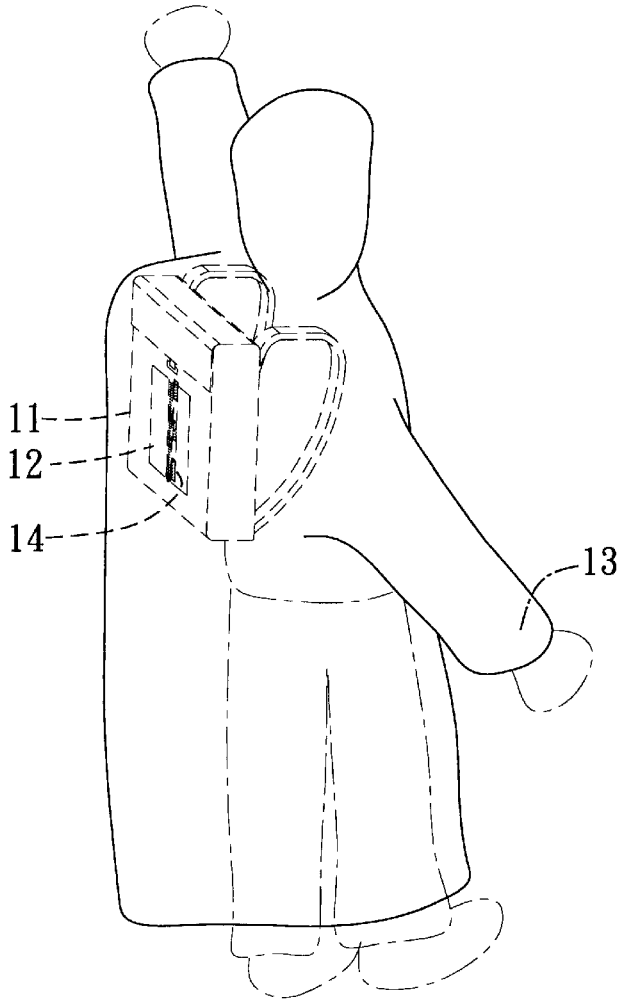
FIG. 5 illustrates how the raincoat is used together with the bag body of FIG. 4.

FIGS. 4 and 5 illustrate another preferred embodiment of the raincoat-integrated backpack assembly 1 modified from that of FIG. 1. Instead of being provided on the rear wall 114 of the bag body 11, the pouch 12 and the raincoat 13 are provided on the front wall 113.

Figure 6:
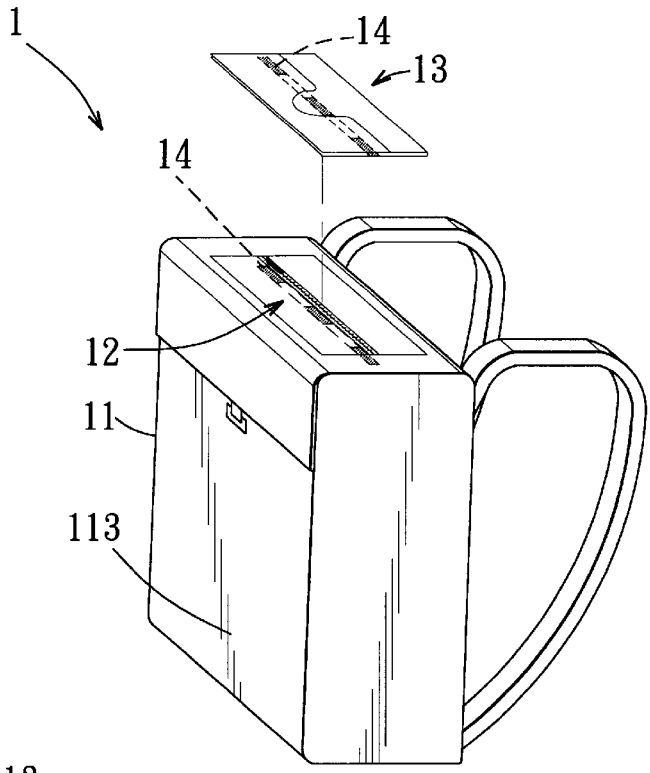
FIG. 6 is an exploded perspective view of yet another preferred embodiment of the backpack assembly of this invention.
Figure 7:
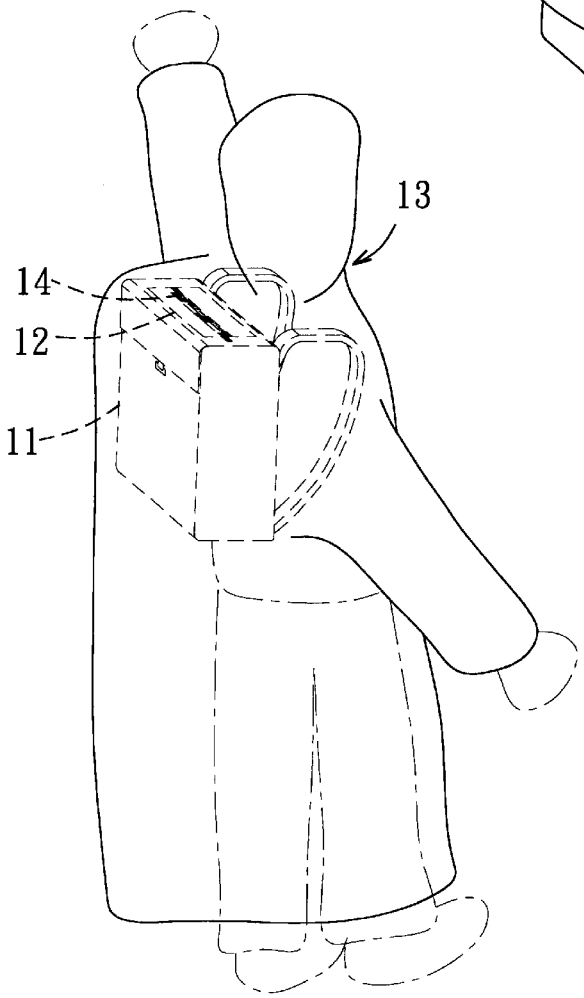
FIG. 7 illustrates how the raincoat is used together with the bag body of FIG. 6.

FIGS. 6 and 7 illustrate yet another preferred embodiment of the raincoat-integrated backpack assembly 1 modified from that of FIG. 1. Instead of being provided on the rear wall 114 of the bag body 11, the pouch 12 and the raincoat 13 are provided on the top cover 117.

With the pouch 12 and the connecting member 14, the raincoat 13 can be integrated with the bag body 11, thereby eliminating the drawbacks associated with the prior art.

With the invention thus explained, it is apparent that various modifications and variations can be made without departing from the spirit of the present invention.

I claim:

1. A raincoat-integrated backpack assembly, comprising:

a raincoat;

a bag body that confines a main receiving space therein and that has a raincoat retaining pouch which confines a raincoat receiving space therein for receiving said raincoat, a pouch opening for permitting access to said raincoat receiving space, and a closure device for closing said pouch opening; and a connecting member disposed in said raincoat receiving space and including male and female interlocking members which are respectively secured to said raincoat and said bag body and which are engageable to each other so as to permit attachment of said raincoat to said bag body.

2. The raincoat-integrated backpack assembly of claim 1, wherein said male and female interlocking members are hook-and-loop fasteners.

3. The raincoat-integrated backpack assembly of claim 1, wherein said closure device is a zipper.

* * * * *